US008524068B2

(12) United States Patent
Medina et al.

(10) Patent No.: US 8,524,068 B2
(45) Date of Patent: Sep. 3, 2013

(54) LOW-RATE ELECTROCHEMICAL ETCH OF THIN FILM METALS AND ALLOYS

(75) Inventors: Jose A. Medina, Pleasanton, CA (US); Tiffany Yun Wen Jiang, San Francisco, CA (US); Ming Jiang, San Jose, CA (US)

(73) Assignee: Western Digital (Fremont), LLC, Fremont, CA (US)

( * ) Notice: Subject to any disclaimer, the term of this patent is extended or adjusted under 35 U.S.C. 154(b) by 125 days.

(21) Appl. No.: 13/221,726

(22) Filed: Aug. 30, 2011

(65) Prior Publication Data

US 2013/0048504 A1 Feb. 28, 2013

(51) Int. Cl.
*C25F 3/00* (2006.01)
*C25F 3/02* (2006.01)

(52) U.S. Cl.
USPC ..... 205/640; 205/644; 205/645

(58) Field of Classification Search
USPC ..... 205/640–686
See application file for complete search history.

(56) References Cited

U.S. PATENT DOCUMENTS

| | | | | |
|---|---|---|---|---|
| 3,097,149 | A * | 7/1963 | Lacroix | 205/656 |
| 6,565,734 | B2 | 5/2003 | Kim et al. | |
| 6,638,414 | B2 | 10/2003 | MacLeod et al. | |
| 8,012,338 | B2 * | 9/2011 | Gilbert et al. | 205/674 |
| 2005/0148198 | A1 | 7/2005 | Ein Eli et al. | |
| 2011/0017608 | A1 | 1/2011 | Taylor et al. | |

OTHER PUBLICATIONS

Microtech Knowledge Base—"Wet etching of chromium", http://www.microtechweb.com/kb/cr_etch.htm, Mar. 30, 2012.

* cited by examiner

*Primary Examiner* — Nicholas A Smith
*Assistant Examiner* — Brian W Cohen

(57) ABSTRACT

Embodiments of the present invention include systems and methods for low-rate electrochemical (wet) etch that use a net cathodic current or potential. In particular, some embodiments achieve controlled etch rates of less than 0.1 nm/s by applying a small net cathodic current to a substrate as the substrate is submerged in an aqueous electrolyte. Depending on the embodiment, the aqueous electrolyte utilized may comprise the same type of cations as the material being etched from the substrate. Some embodiments are useful in etching thin film metals and alloys and fabrication of magnetic head transducer wafers.

14 Claims, 11 Drawing Sheets

LOW-RATE ELECTROCHEMICAL ETCH OF THIN FILM METALS AND ALLOYS

TECHNICAL FIELD

This invention relates to etching and more specifically, to low-rate electrochemical etching of metals and alloys, such as those used in disk drives.

BACKGROUND

Etching is widely known and used in metal and alloy processing and, in particular, electronics manufacturing. For instance, etching is commonly used in fabrication of magnetic recording heads. The etching may be accomplished by a number of methodologies, including chemical (wet) etching, electrochemical (wet) etching and (dry) ion milling.

During chemical (wet) etching, a substrate is submerged in a strong acid or alkaline solution and the surfaces of the substrate exposed to the solution are etched away. During electrochemical (wet) etching, a substrate is also submerged in a strong acid or alkaline solution and the surfaces of the substrate exposed to the solution are etched away. However, unlike chemical (wet) etching, once the substrate is submerged in the solution, a net anodic current is applied to the substrate to facilitate the etching process, where the net anodic current comprises a large partial anodic current component and a smaller partial cathodic current component.

During (dry) ion milling, the etching is facilitated by bombarding the surface of the substrate with submicron ion particular (e.g., Argon ions). Typically, as the ions bombard the substrate surface, the material disposed on the surface is etched away. The ion milling is usually performed while the substrate is in a vacuum chamber, and the substrate is placed on a rotating platform to ensure uniform etching of the substrate.

Depending on the substrate and the material on the substrate being etched, either of these etching methods may use protective layers (e.g., photoresist layers or hardmask layers) to protect underlying layers of the substrate from the etch process.

BRIEF DESCRIPTION OF THE DRAWINGS

The present invention is illustrated by way of example, and not limitation, in the figures of the accompanying drawings in which.

DETAILED DESCRIPTION

In the following description, numerous specific details are set forth, such as examples of specific layer compositions and properties, to provide a thorough understanding of various embodiment of the present invention. It will be apparent however, to one skilled in the art that these specific details need not be employed to practice various embodiments of the present invention. In other instances, well known components or methods have not been described in detail to avoid unnecessarily obscuring various embodiments of the present invention.

Embodiments of the present invention include systems and methods for low-rate electrochemical (wet) etch is provided using a net cathodic current or potential. In particular, some embodiments achieve controlled etch rates of less than 0.1 nm/s by applying a small net cathodic current to a substrate as the substrate is submerged in an aqueous electrolyte. Depending on the embodiment, the aqueous electrolyte utilized may comprise the same type of cations as the material being etched from the substrate. Some embodiments are useful in etching thin film metals and alloys and fabrication of magnetic head transducer wafers.

Use of various embodiments allow for: (a) controlled and low-rate etching in a mild chemical environment; (b) selective etching of the least noble materials from a substrate; (c) avoid damage to adjacent layers of the substrate, which commonly occurs from over-etching in traditional chemical or electrochemical etch, or from over-milling in traditional ion milling; (d) etching using standard electroplating tools to perform etching; and (e) partial etching.

For example, with regard to etching least noble materials, some embodiments of the present invention can be used to etch high-Fe NiFe, CoFe, and CoNiFe magnetic alloys that are in contact with lower-Fe magnetic alloys or with non-magnetic more-noble alloys or pure metals. In another example, standard electroplating tools with cathodic current control and uniform convective mass transfer distribution on the substrate surface can be used to perform etching in accordance with some embodiments.

In accordance with some embodiments, use of standard electroplating tools allows the tool to be used for low-rate etching and plating. For instance, the chemistries used by standard electroplating tools for magnetic alloy plating are usually: (a) mildly acidic, which allows for etch rates as low as sub-nanometer/s; and (b) contain high ionic concentration of the materials under etch (typically $Co^{+2}$, $Ni^{+2}$, $Fe^{+2}$), which allows for minimization or elimination of possible contamination. Additionally, for some embodiments, the combination of cathodic electrochemical etch with electrochemical deposition in a single plating cell can be used on the fabrication of complex nanometer-scale structures, such as high-moment VP3 damascene poles.

Figure 1A:
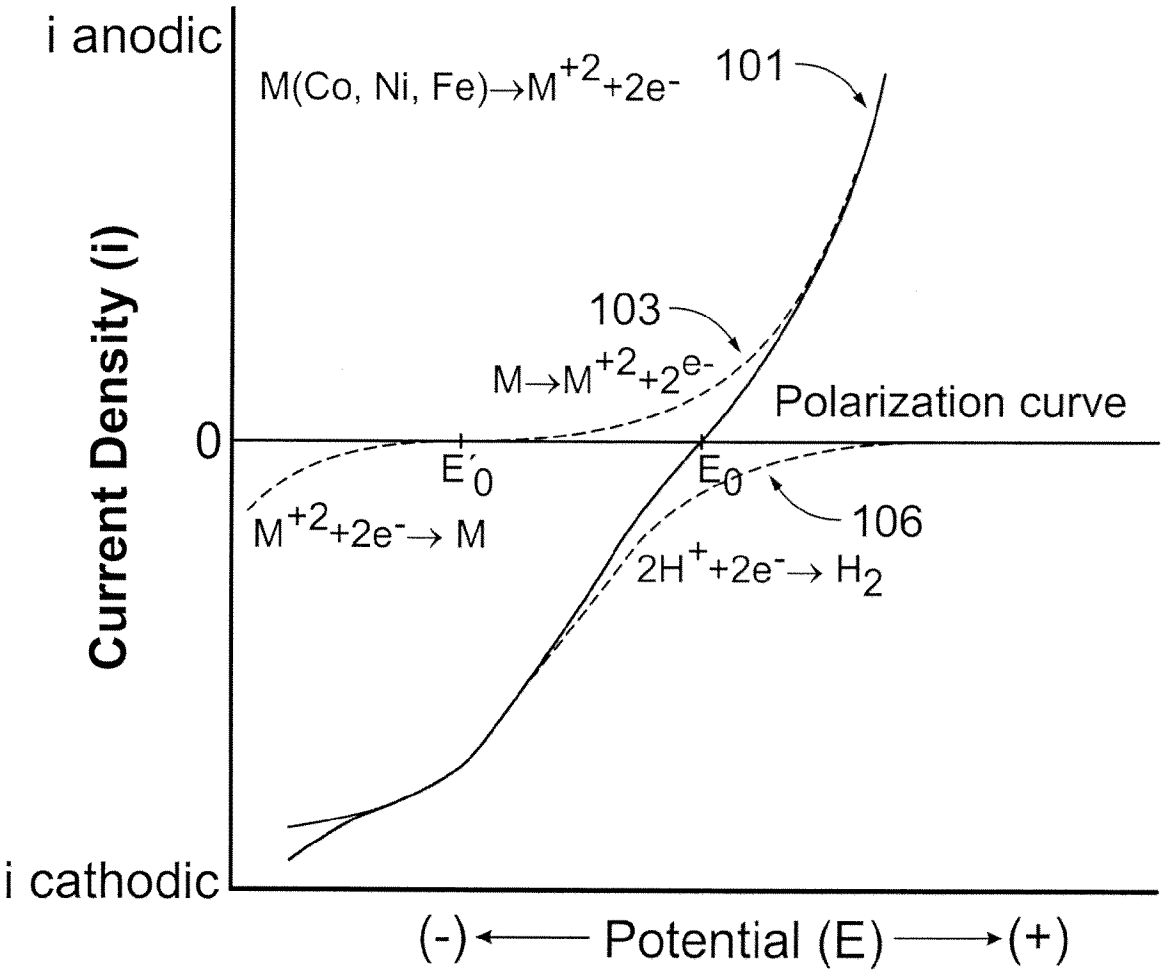
FIGS. 1A-1C are graphs depicting a polarization curve, and individual current components thereof, for an example substrate comprising of a metal or alloy material in an acidic solution in accordance with various embodiments of the present invention.
Figure 1B:
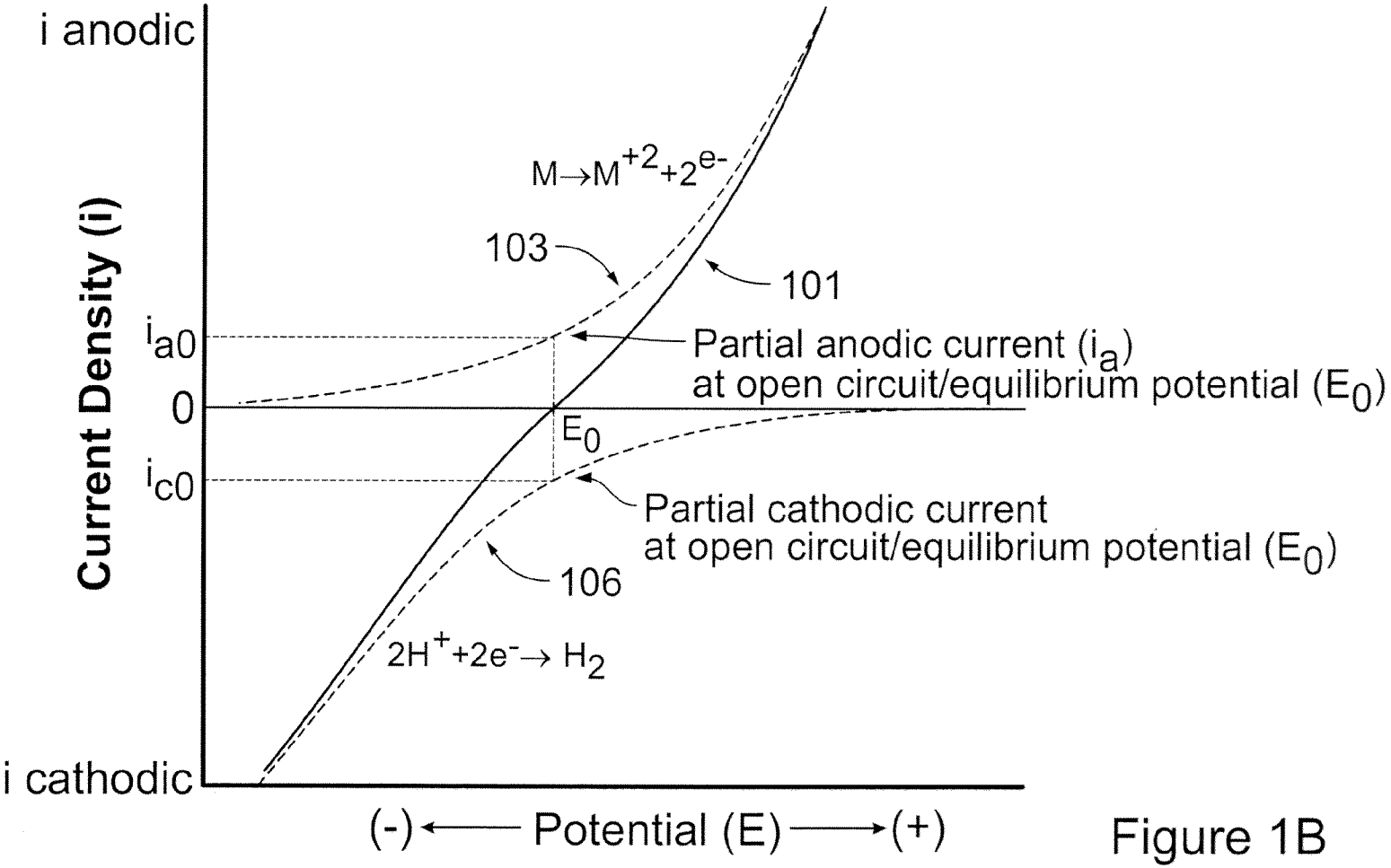
Figure 1C:
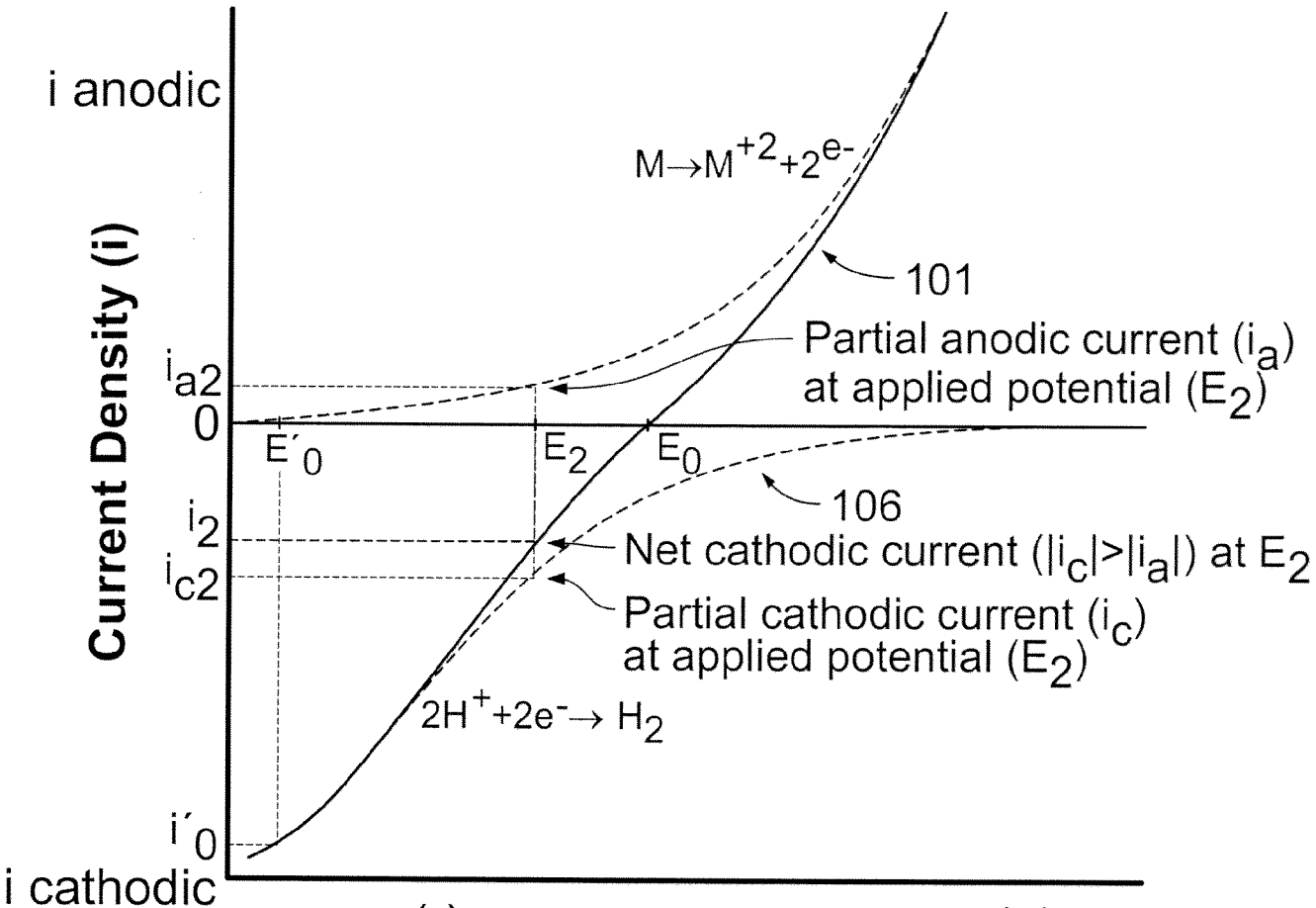

To describe the functionality of some embodiments, we now turn to FIGS. 1A-1C, which illustrate a polarization curve 101, and the current components (represented by polarization curves 103 and 106) thereof, for a metal/alloy material (M) in an acidic solution in accordance with various embodiments of the present invention.

FIG. 1A depicts a polarization curve 101 for an example substrate of metal/alloy material (M) in the presence of an aqueous acidic electrolyte comprising divalent ions of the same material ($M^{+2}$). The polarization curve 101 is the net current of the example substrate (of material M) in response to an applied potential (E). As shown, current will flow through the example substrate (i.e., current density will decrease or increase) as E becomes more negative (causing a net cathodic current to flow through the example substrate) or more positive (causing a net anodic current to flow through the example substrate) than the system's open circuit or equilibrium potential ($E_0$), the system comprising the example substrate in the aqueous acidic electrolyte. As described herein, as E becomes more negative than $E_0$, a net cathodic current (also referred to herein as a cathodic current) results in the example substrate, and as E becomes more positive than $E_0$, a net anodic current (also referred to herein as a anodic current) results in the example substrate. At the equilibrium potential ($E_0$) no net current will flow through the example substrate (i.e., i=0).

The polarization curve 101 represents the net contribution of individual polarization curves 103 and 106 (dashed curves) for separate electrochemical processes that take place on the electroactive surface of the example substrate. The top polarization curve 103 corresponds to the polarization curve for the $M/M^{+2}$ couple that results when the example substrate is placed in the acidic electrolyte. As shown, an oxidation of M ($M \rightarrow M^{+2}+2e^-$) or reduction of $M^{+2}$ ($M^{+2}+2e^- \rightarrow M$) occurs as E becomes either more positive or more negative than the open circuit or equilibrium potential of $M/M^{+2}$ ($E'_0$). The bottom polarization curve 106 corresponds to the polarization curve for the hydrogen reduction reaction ($2H^++2e^- \rightarrow H_2$) that results when the example substrate is placed in the acidic electrolyte.

It should be noted that no crossing point with the potential (E) axis is observed by the bottom polarization curve 106 due to the fact that $H_2$ is generally not present in aqueous acidic solutions such as the one being considered in FIG. 1A.

FIG. 1B is a magnification of the polarization curve 101 of FIG. 1A and illustrates the cancelling contribution effect of the partial anodic current ($i_a$) and the partial ($i_c$) cathodic current at $E_0$ (i.e., $i_{a0}=-i_{c0}$) flowing through the example substrate. Under such conditions the oxidation reaction ($M \rightarrow M^{+2}+2e^-$) and the reduction reaction ($2H^++2e^- \rightarrow H_2$) will take place at rates that are proportional to $i_{a0}$ and $i_{c0}$, respectively. Accordingly, although no net current will flow through the example substrate (i.e., $i=i_{a0}+i_{c0}=0$) at the equilibrium potential ($E_0$), electrochemical processes on the substrate still take place and cause electrochemical etching of M from the example substrate without an external driving force (i.e., i=0) being present.

FIG. 1C is another magnification of the polarization curve 101 of FIG. 1A and illustrates the case where an applied cathodic potential of $E_2$ between $E'_0$ and $E_0$ results in a net cathodic current ($I_2$) flowing through the example substrate. In particular, by biasing the system such that the potential (E) of the system is more negative than $E_0$ (e.g., where $E=E_2$), a large partial cathodic current component (e.g., $i_{c2}$) and a smaller partial anodic current component (e.g., $i_{a2}$) results such that $|i_c|>|i_a|$. The net cathodic current produced flows through the example substrate, and increases exponentially as a function of E in the absence of mass transfer limitations. As illustrated in FIG. 1C, the oxidation reaction ($M \rightarrow M^{+2}+2e^-$) and the reduction reaction ($2H^++2e^- \rightarrow H_2$) are driven at rates that are proportional to the partial currents $i_{a2}$ and $i_{c2}$ respectively. As the potential increases in the negative direction, the anodic partial current component becomes smaller and eventually vanishes at the equilibrium potential ($E'_0$) of $M/M^{+2}$, while the cathodic component becomes predominant. In the region between equilibrium potentials $E'_0$ and $E_0$, slow oxidation of M and fast reduction of $H^+$ occurs, thereby resulting in a low-rate electrochemical etch of the example substrate.

Figure 2:
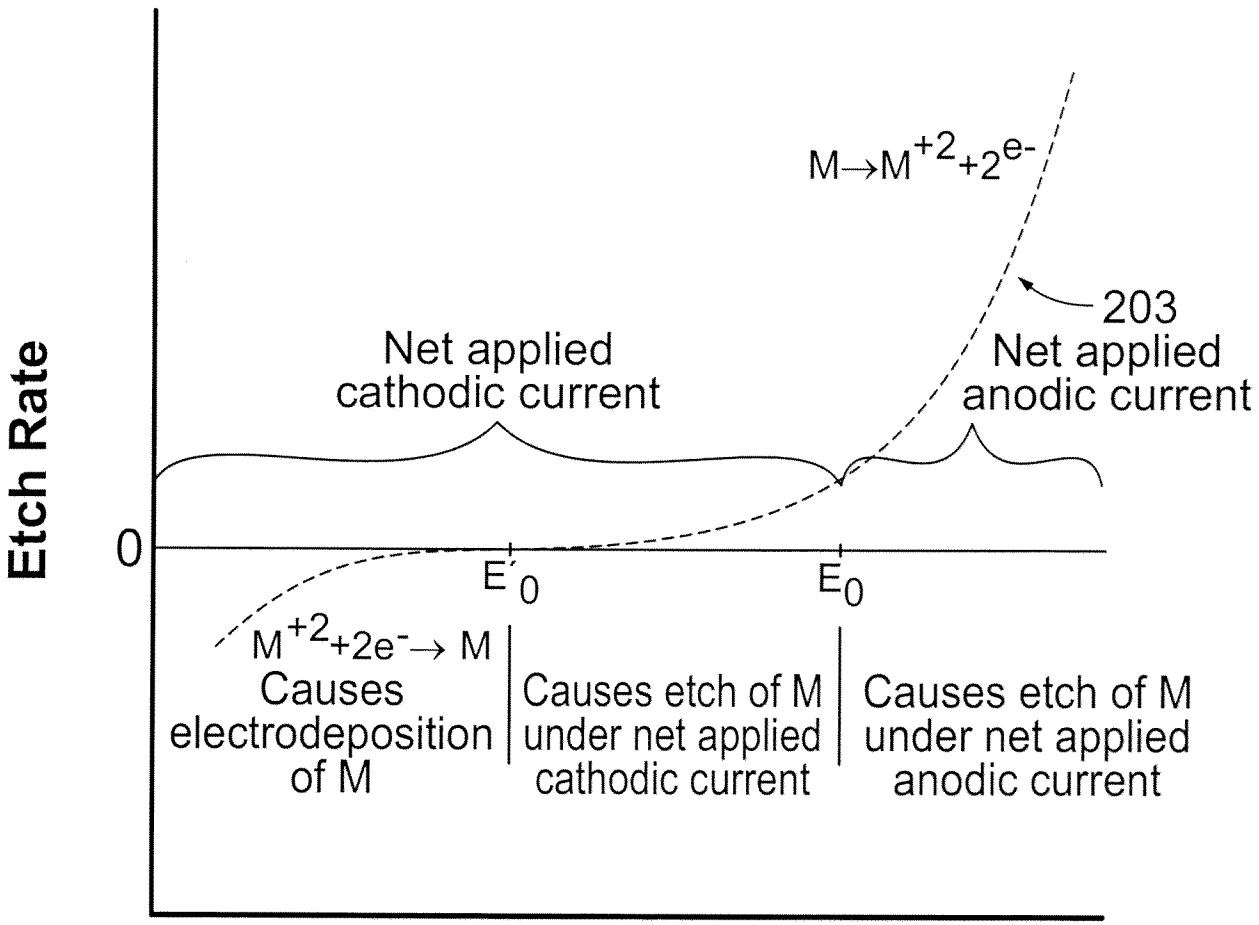
FIG. 2 is a graph depicting an etch rate as a function of potential in accordance with an embodiment of the present invention.

FIG. 2 is a graph depicting an etch rate curve 203 as a function of potential, illustrating how some embodiments achieve the low and controlled etch rates of M from a given substrate comprising M. As shown in FIG. 2, some embodiments achieve low and controlled etch rates of M from the example substrate by controlling the potential of the example substrate such that the potential falls within a range between the equilibrium potentials $E_0$ and $E'_0$. As noted herein, when the potential (E) of becomes more positive than the equilibrium potential ($E_0$) of M, a net applied anodic current is being applied to the given substrate, and when the potential (E) of becomes more negative than the equilibrium potential ($E_0$) of M, a net applied cathodic current is being applied to the given substrate. As such, when a net cathodic current is applied to the example substrate such that its potential is between the equilibrium potentials $E_0$ and $E'_0$, a low-rate etching of M from the example substrate results.

As observed in FIG. 2, when zero current is applied to the example substrate (i.e., the potential of the example substrate is at $E_0$), the system achieves the highest etch rate of M without the use of any net current. When a net cathodic current is applied to the example substrate such that the potential of substrate is closest to $E'_0$, the lowest etch rate of M can be achieved using a net cathodic current. If a net cathodic current is applied to the substrate such that the potential (E) is equal to or more negative than the equilibrium potential ($E'_0$) of $M/M^+$, electrodeposition of M would likely occur if $M^{+2}$ is also present in the system. The etch rate curve 203 illustrates how the etch rate of M is proportional to the partial anodic current density for the oxidation reaction ($M \rightarrow M^{+2}+2e^-$), and how the etch rate of M has an exponential dependence on the potential (E) in the absence of mass transfer limitations.

Figure 3:
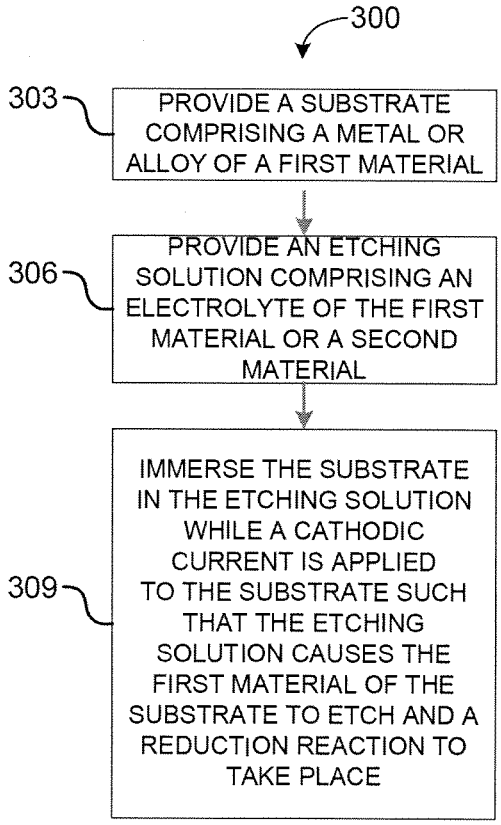
FIG. 3 is a flowchart illustrating an example method for etching in accordance with an embodiment of the present invention.

FIG. 3 is a flowchart illustrating an example method for etching in accordance with an embodiment of the present invention. The example method 300 begins with operation 303, when a substrate comprising a metal or alloy of a first material is provided for etching, and operation 306, when an etching solution comprising an electrolyte of the first material or a second material is provided for the etch process. The substrate, for example, may comprise pure metals or alloys of Co, Ni, or Fe (e.g., NiFe, CoFe, CoNi, CoNiFe), or alloys of NiFeX, CoFeX, or CoNiFeX, where X can denote Pt, Ru, Rh, Pd, Cr, or Cu. The etching solution, for example, may comprise cations of Fe(II), Ni(II), or Co(II) with high conductivity provided by a supporting electrolyte, which may also contain buffering compounds and wetting agents. Example etching solutions include, but are not limited to, NiFe, CoFe, and CoNiFe plating bath chemistries. Accordingly, in one embodiment, to etch a substrate comprising a CoNiFe film, an etching solution comprising CoNiFe plating solution may be utilized.

The etch process begins at operation 309, when the substrate is immersed in the etching solution while a (net) cathodic current is applied to the substrate, the cathodic current being such that etching solution causes the first material of the substrate to etch and a reduction reaction to take place.

As described herein, in some embodiments the cathodic current is such that the potential of the substrate and electrolyte falls within a range between the equilibrium potentials of $E_0$ and $E'_0$ for the first material of the substrate and the first material or the second material of the electrolyte.

For instance, in the case of a substrate comprising a CoNiFe film and an etching solution comprising CoNiFe plating solution, the potential of the system comprising the CoNiFe film and the CoNiFe plating solution would need to fall within the range between the equilibrium potentials of $E_0$ and $E'_0$ of the system.

Depending on the embodiment, the operation 309 may comprise preparing the substrate for application of a cathodic current before the substrate is immersed in the etching solution, or applying a cathodic current after the substrate is immersed in the etching solution. In some embodiments, the cathodic current is applied to the substrate by way of a galvanostatic method (e.g., using constant current control) or a potentiostatic method (e.g., using a constant potential control). Additionally, in some embodiments, causing and controlling the low-rate etch of the substrate comprises maintaining the temperature, pH, electrolyte concentration, and mixing rate of the etching solution at or close to a specified value. Accordingly, embodiments of the present invention may utilize tools that can maintain constant electrolyte temperature, provide uniform electrolyte mixing onto the surface of the substrate being etched, and provide a constant and controllable DC current flow between the substrate and an anode. As noted herein, standard electroplating tools (e.g., those used for plating NiFe, CoFe, and CoNiFe) could be utilized in some embodiments of the present invention.

The method 300 and other embodiments may be utilized with substrates comprising etch plating or sputtered structures, and may be used to fabricate such disk drive components as magnetic recording heads. According to some embodiments, the method 300 further comprises remove an oxide from the substrate using the etch process and electrodepositing a first material or a second material onto the substrate using the plating process. For instance, subsequent to removing an oxide from the substrate comprising a material M using an etch process in accordance with one embodiment, the (net) cathodic current utilized to etch the oxide from the substrate could be increased past the equilibrium potential of the $M/M^{+2}$ (i.e., $E'_0$) such that electrodeposition of M onto the substrate takes place.

It should be noted that for some embodiments, the etch process is performed only when more noble or non-electroactive structures are adjacent to the material under etch. In some embodiments, a constant electroactive area on the substrate is maintained when etch of the substrate is being performed.

Figure 4:
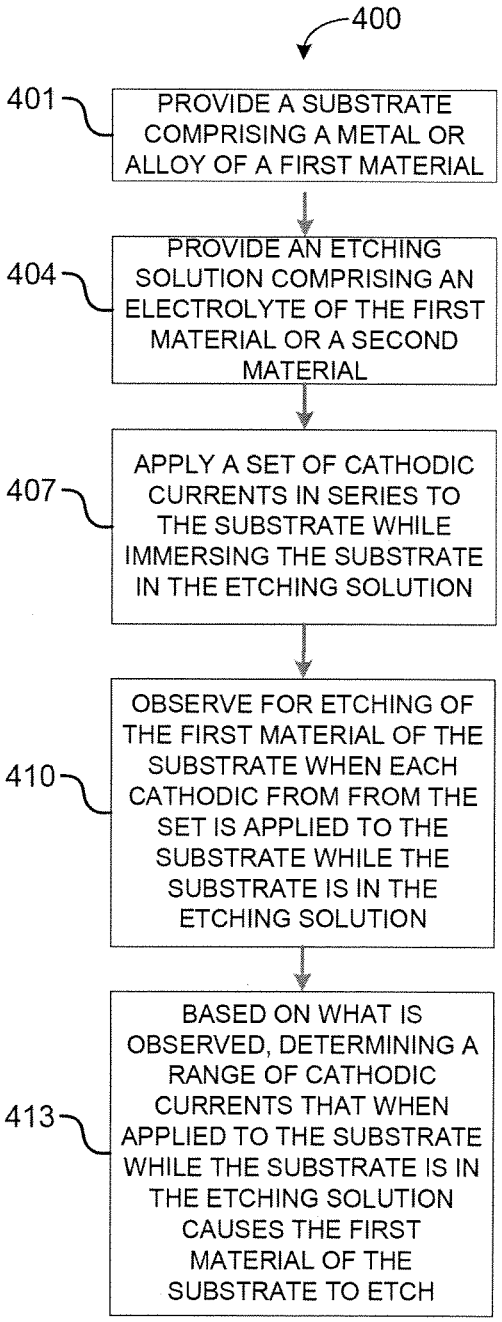
FIG. 4 is a flowchart illustrating an example method for determining a range of currents in accordance with an embodiment of the present invention.

FIG. 4 is a flowchart illustrating an example method for determining a range of currents in accordance with an embodiment of the present invention. The range of current determined by the example method 400 are used to calibrate and facilitate electrochemical etch processes in accordance with an embodiment of the present invention. The method 400 begins with operation 401, when a substrate comprising a metal or alloy of a first material is provided for etching, and operation 404, when an etching solution comprising an electrolyte of the first material or a second material is provided for the etch process.

Subsequently, at operation 407, a set of cathodic currents is applied in series to the substrate while the substrate is immersed in the etching solution. In some embodiments, each cathodic current in the set has a different cathodic current value being evaluated for the electrochemical etch process. In various embodiments, the set of cathodic current ranges from the "zero current" (i.e., equilibrium potential $E_0$ for the system) where the etch rate is maximum to a net cathodic current value where the etch rate becomes zero and electrodeposition may begin (i.e., equilibrium potential $E'_0$ for the system).

As each cathodic current is applied to the substrate while the substrate is in the etching solution, at operation 410 the first material of the substrate is observed for etching. Depending on the embodiment, the etching may be observed by a number of ways including, but not limited to, profilometry, x-ray flourescence (XRF), or detecting a change in saturation magnetization of the substrate.

Based on what is observed during operation 410 for each of the cathodic currents applied from the set, at operation 413 a range of cathodic currents can be determined that cause the first material to etch from the substrate when the substrate is immersed in the etching solution.

Figure 5:
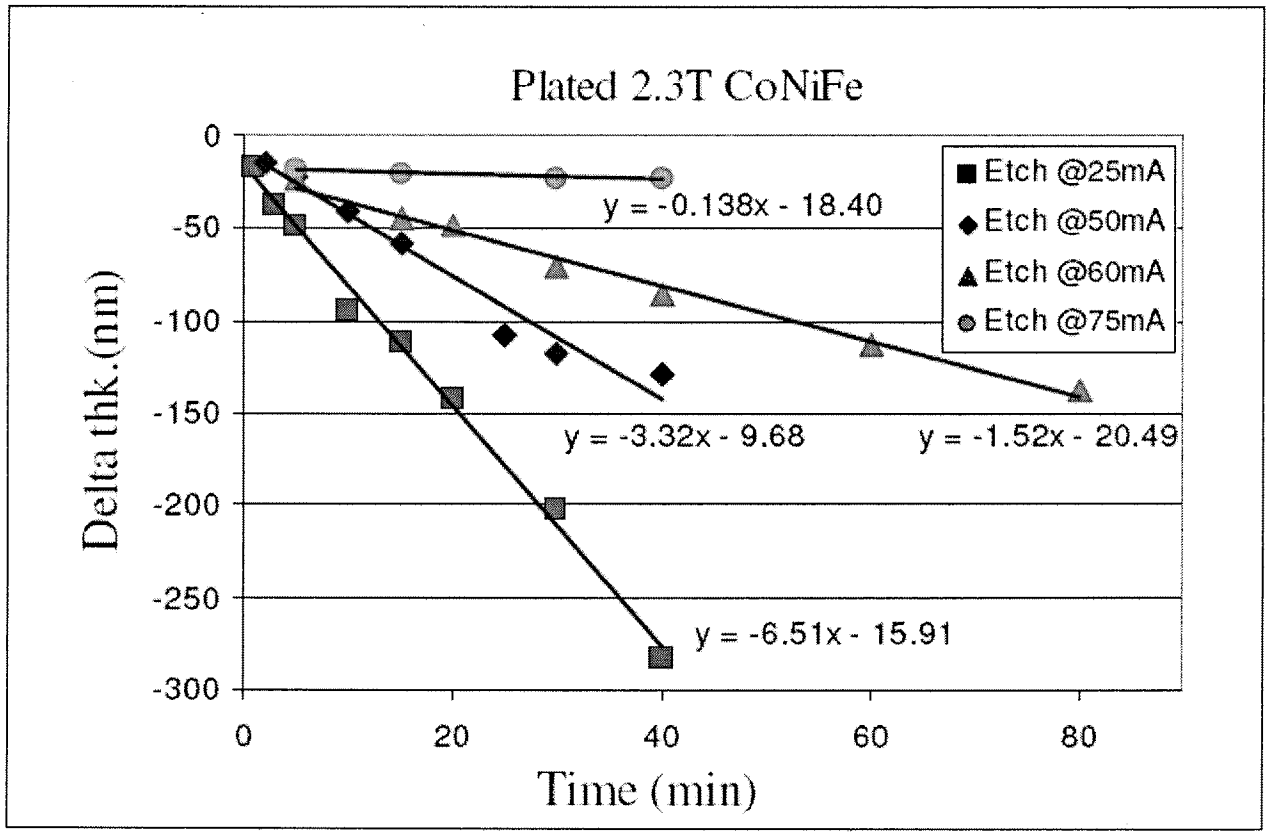
FIG. 5 is a graph representing example material removal (thickness reduction) as a function of time for an example alloy based on current conditions in accordance with an embodiment of the present invention.

FIG. 5 is a graph representing example material removal (thickness reduction) as a function of time for an example alloy based on current conditions in accordance with an embodiment of the present invention. FIG. 5 illustrates electroplated 2.3T CoNiFe films subjected to net cathodic currents ranging from 25 to 75 mA in accordance with an embodiment of the present invention. The electroplated 2.3T CoNiFe films had an initial thickness of approximately 0.5 um and were deposited as full films onto 6" AlTiC substrates seeded with ~500 A of sputtered Ta/Ru.

As illustrated in FIG. 5, each data point in the graph corresponds to the thickness reduction of the CoNiFe film on the substrate as function of time as the substrate is subjected to the specified net cathodic current. The etching electrolyte in this case was the same 2.3T CoNiFe plating solution with pH of 2.80, temperature of 18° C., and comprised cobalt, nickel, and iron divalent ions from sulfate salts, boric acid, ammonium chloride, surfactant, and grain refining organic agents. The etch rates in FIG. 5 correspond to the slope of the linear regression fitting curves.

Figure 6:
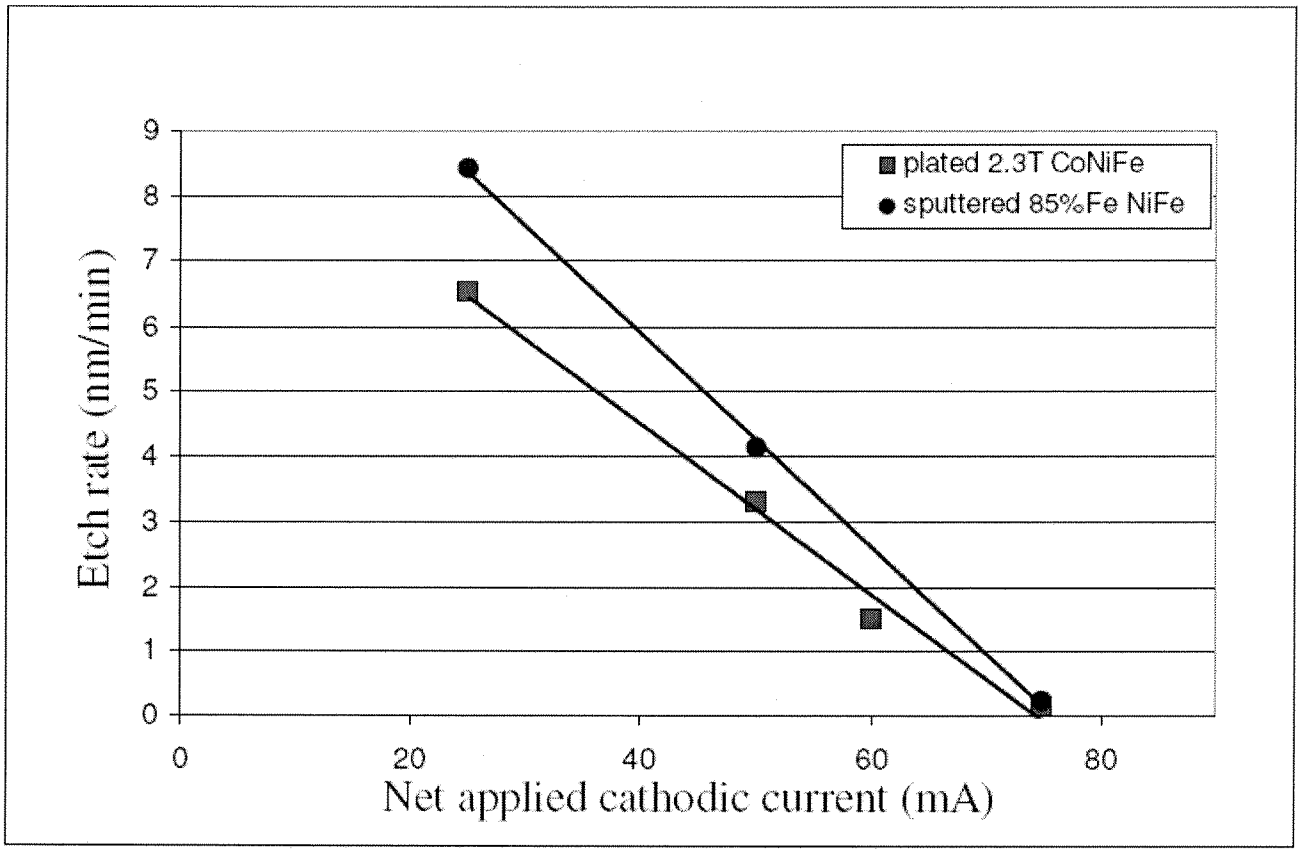
FIG. 6 is a graph representing example etch rates of an example alloy based on current conditions in accordance with an embodiment of the present invention.

FIG. 6 is a graph representing example etch rates of an alloy based on current conditions in accordance with an embodiment of the present invention. FIG. 6 shows etch rates as a function of net applied cathodic currents for the plated 2.3T CoNiFe films described herein and for sputtered NiFe films with 85% Fe content and initial thickness of ~500 A deposited onto a 500 A Ta/Ru underlayer. These sputtered films were etched at the specified net cathodic currents conditions applied in the 2.3T CoNiFe plating described above for FIG. 5.

Figure 7:
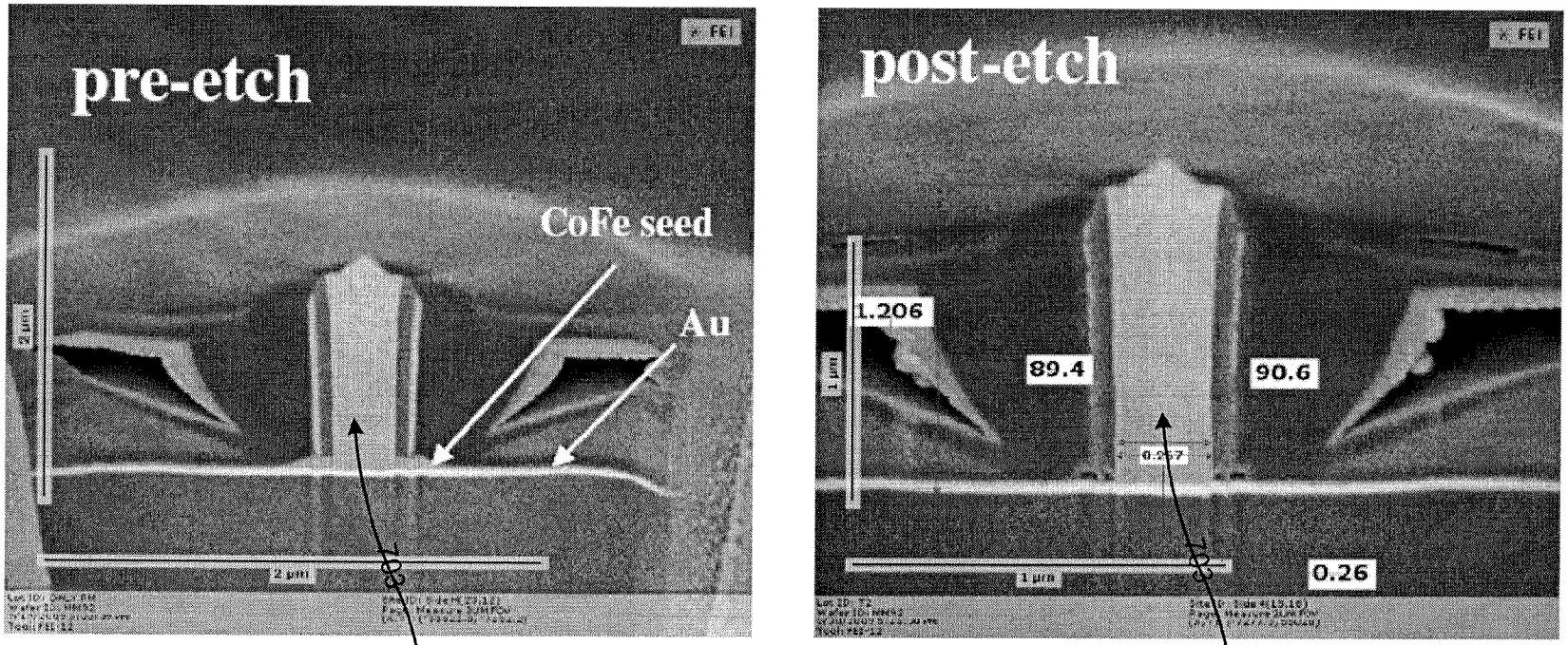
FIG. 7 are images of an example seed material pre-etch and post-etch in accordance with an embodiment of the present invention.

FIG. 7 are images of an example seed material pre-etch and post-etch in accordance with an embodiment of the present invention. FIG. 7 illustrates the case where a net cathodic current of 50 mA was used during 60 seconds to remove residual CoFe seed to the base of a magnetic writer pole 703. The etching hardware comprised a plating cell with reciprocating paddle that provided uniform mixing to the substrate, and 2.3T CoNiFe plating electrolyte used as an etching medium.

Figure 8:
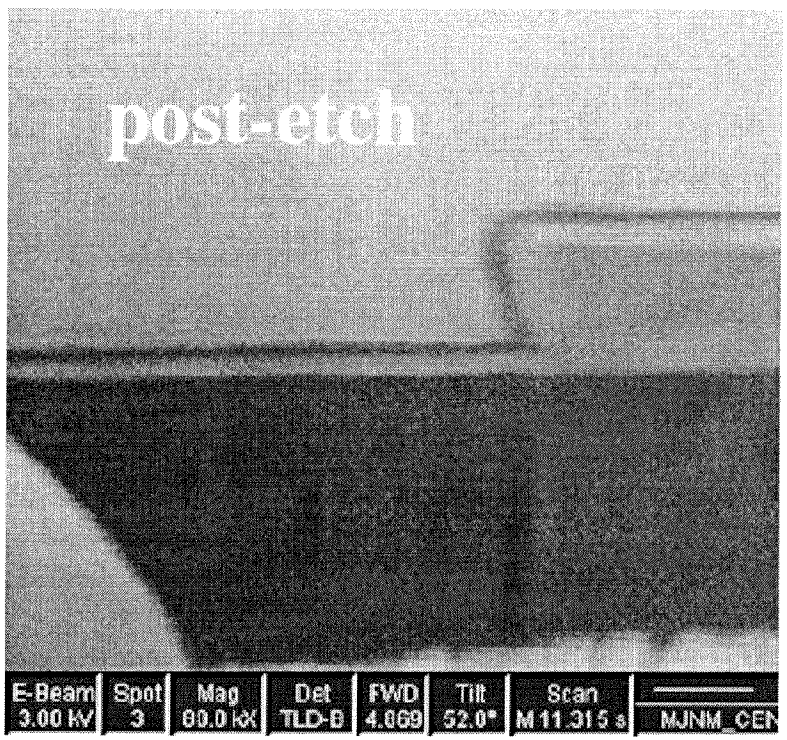
FIG. 8 are images of an example seed layer pre-etch and post-etch in accordance with an embodiment of the present invention.
Figure 8:
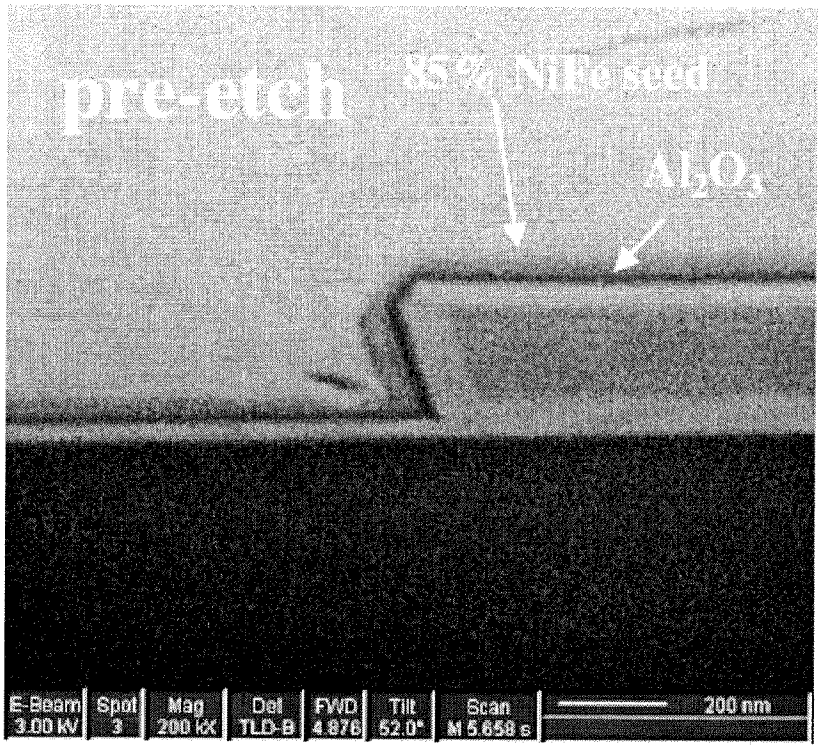

FIG. 8 are images of an example seed layer pre-etch and post-etch in accordance with an embodiment of the present invention. FIG. 8 illustrates an electrochemical etch of NiFe (85% Fe) seed layer deposited onto writer pole alumina gap material. In FIG. 8, a net cathodic current of 50 mA was applied during 180 seconds on a patterned 6" substrate with partially exposed S3 seed layer. Like FIG. 7, the etching hardware comprised a plating cell with reciprocating paddle that provided uniform mixing to the substrate, and 2.3T CoNiFe plating electrolyte used as an etching medium.

Figure 9:
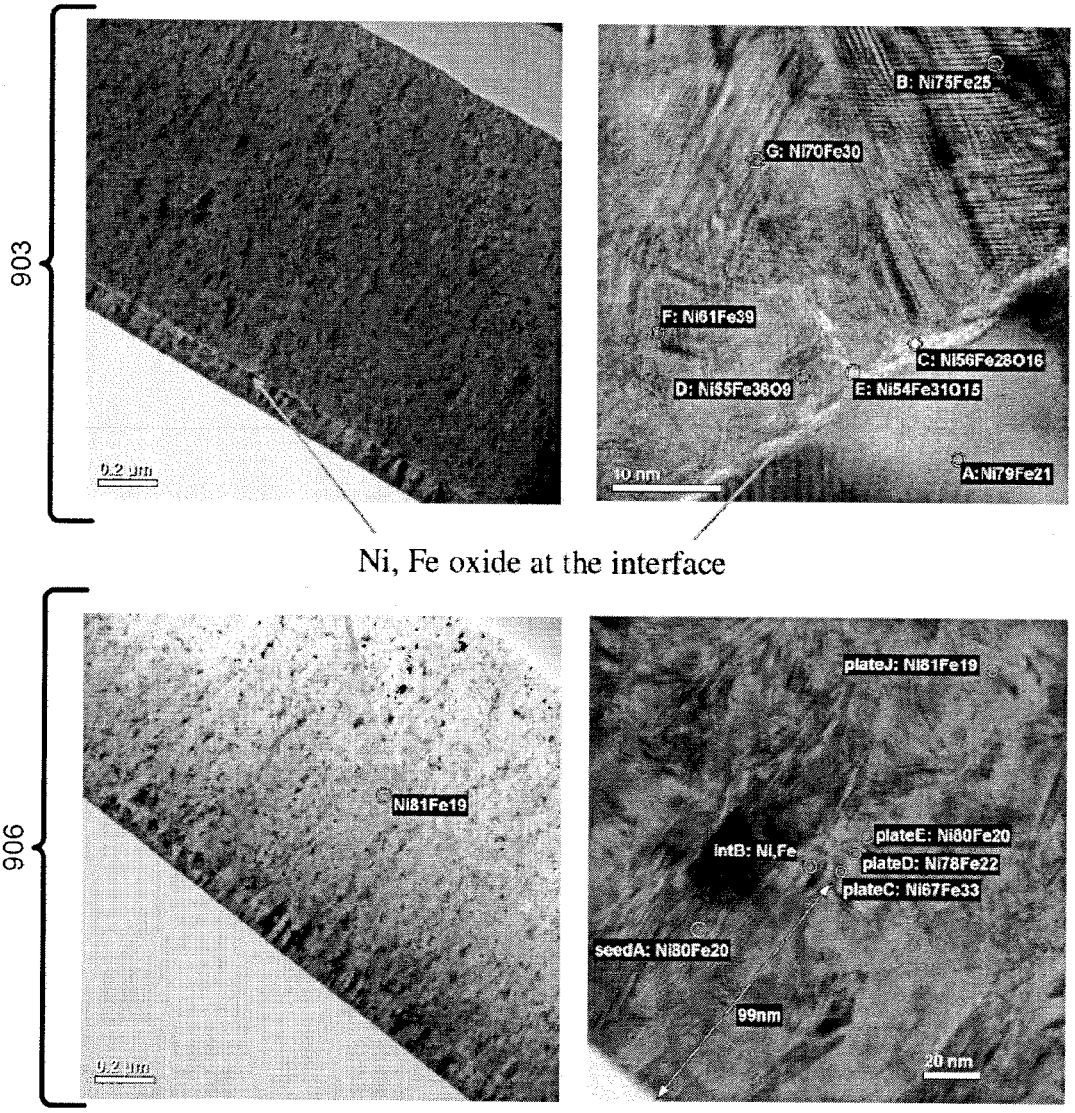
FIG. 9 are images of example materials pre-etch and post-etch in accordance with an embodiment of the present invention.

As noted herein, in some embodiments the removal of oxide by the etch process can be followed by an electrodeposition process of material. FIG. 9 are images of example materials pre-etch and post-etch in accordance with such an embodiment of the present invention. In FIG. 9, the electrochemical etch process is used to remove oxide prior to plating as a way to improve the adhesion between plated NiFe and sputtered seed layers. FIG. 9 presents transmission electron microscope (TEM) images of NiFe materials with nominal composition in the range of 20-30% Fe plated onto a seed layer comprising 100 nm of NiFe (20% Fe). The top images 903 illustrate the case where no net cathodic current in accordance with an embodiment was used prior to plating, while the bottom images 906 correspond to the case where net cathodic current in accordance with an embodiment (specifically, 100 mA) was applied during 60 seconds prior to plating to effectively eliminate the native seed layer oxide.

What is claimed is:

1. A method for electrochemical etching, the method comprising:

providing a substrate comprising a metal or alloy of a first material;

providing an etching solution comprising an electrolyte of a second material; and immersing the substrate in the etching solution while applying a cathodic current to the substrate, wherein the cathodic current is applied such that the etching solution causes the first material of the substrate to etch and the etching solution causes a reduction reaction to take place and wherein applying the cathodic current to the substrate comprises increasing a current density through the substrate from a zero net current through the substrate to a first net current through the substrate, wherein the first net current is more cathodic than the zero net current.

2. The method of claim 1, wherein the cathodic current comprises an anodic current component that causes the first material of the substrate to etch and a cathodic current component that causes the reduction reaction to take place.

3. The method of claim 1, wherein applying the cathodic current to the substrate comprises applying a first potential to the substrate, wherein the first potential is more negative than an open-circuit potential of a couple comprising the first material and the etching solution.

4. The method of claim 3, wherein the first potential is less negative than a second potential of the first material, wherein the second potential is a second open-circuit potential of a couple comprising the first material and an ion of the first material.

5. The method of claim 1, wherein the current density through the substrate is increased such that: the first net current has a larger anodic component than, or equal anodic component as, a net current through the substrate having a zero anodic component, and the first net current has a smaller anodic component than the zero net current.

6. The method of claim 1, further comprising adjusting the cathodic current in order to adjust an etch rate of the first material of the substrate.

7. The method of claim 6, wherein controlling the cathodic current such that the first material of the substrate is etched at an etch rate that provides nanometer-level or angstrom-level etch precision.

8. The method of claim 1, wherein the cathodic current is controlled by way of a galvanostatic method or a potentiostatic method.

9. The method of claim 1, further comprising maintaining a temperature, pH, electrolyte concentration, and mixing rate of the etching solution at or close to a specified value.

10. The method of claim 1, wherein the second material contains a same or similar element to that found in the first material.

11. The method of claim 1, wherein the method is used to etch plated or sputtered structures.

12. The method of claim 1, wherein the method is used to fabricate a magnetic recording head.

13. The method of claim 1, wherein the method is used to remove an oxide from the substrate.

14. The method of claim 13, wherein subsequent to the oxide being removed using the method, the cathodic current is increased such that while the substrate is immersed in the etching solution, the first material or a second material is electrodeposited onto the substrate.

* * * * *